United States Patent [19]

McDonough

[11] Patent Number: 4,548,363

[45] Date of Patent: Oct. 22, 1985

[54] MUZZLE FOR ELECTROSTATIC SPRAY GUN

[75] Inventor: Charles M. McDonough, Stamford, Conn.

[73] Assignee: PCF Group, Inc., Stamford, Conn.

[21] Appl. No.: 529,493

[22] Filed: Sep. 6, 1983

[51] Int. Cl.[4] ..... B05B 5/02

[52] U.S. Cl. ..... 239/698; 239/707; 361/227

[58] Field of Search ..... 239/3, 697, 698, 706-708, 239/704; 361/227, 228

[56] References Cited

U.S. PATENT DOCUMENTS

| | | | |
|---|---|---|---|
| 2,766,064 | 10/1956 | Schweitzer . | |
| 2,855,245 | 10/1958 | Sedlacski, Jr. . | |
| 3,056,557 | 10/1962 | Walberg . | |
| 3,246,844 | 4/1966 | Lehman et al. . | |
| 3,382,091 | 5/1968 | Drum . | |
| 3,554,445 | 1/1971 | Engwall et al. . | |
| 3,608,823 | 9/1971 | Buschor et al. . | |
| 3,667,675 | 6/1972 | Sherman et al. | 239/698 |
| 3,774,573 | 11/1973 | Hindell . | |
| 3,901,184 | 8/1975 | Payne et al. . | |
| 4,011,991 | 3/1977 | Masuda . | |
| 4,066,041 | 1/1978 | Buschor et al. . | |
| 4,090,666 | 5/1978 | Peck . | |
| 4,114,810 | 9/1978 | Masuda . | |
| 4,135,667 | 1/1979 | Benedek et al. | 239/697 |
| 4,158,071 | 6/1979 | Jordan et al. . | |
| 4,163,520 | 8/1979 | Garcin et al. | 239/707 |
| 4,169,560 | 10/1979 | Vohringer | 239/698 |

FOREIGN PATENT DOCUMENTS

| | | | |
|---|---|---|---|
| 1125446 | 8/1968 | United Kingdom | 239/697 |
| 2018625 | 10/1979 | United Kingdom | 239/698 |
| 601054 | 5/1978 | U.S.S.R. | 239/706 |

*Primary Examiner*—Andres Kashnikow
*Assistant Examiner*—Mary Beth O. Jones
*Attorney, Agent, or Firm*—Barry R. Lipsitz

[57] ABSTRACT

An electrostatic spray gun muzzle comprises an insulating tube having a rear end adapted to be mounted in an electrostatic spray gun and a front end providing an exit for charged coating material. A conductive rod is mounted axially within the tube and has a conductive pin extending radially from one end thereof. The pin is electrically connected to a power terminal when the rear end of the insulated tube is mounted in a spray gun. A plurality of conductive centering bars extend radially from the rod, adjacent the front end of the insulating tube, to maintain the rod in centered, axial alignment with the insulating tube. An insulating deflector is mounted to the conductive rod, forward of the front end of the insulating tube.

15 Claims, 7 Drawing Figures

MUZZLE FOR ELECTROSTATIC SPRAY GUN

BACKGROUND OF THE INVENTION

The present invention relates to apparatus for electrostatic spray coating and more particularly to a new and improved muzzle for use in a conventional electrostatic spray gun.

The prior art discloses various types of apparatus for atomizing liquid or pulverized coating material and for the electric charging of the atomized particles. It is a fundamental law of physics that unlike charges attract. Thus, by charging coating material particles to one polarity and an article to be coated to the opposite polarity the coating particles will be attracted to the surface of the article to be coated, and high quality coatings can be achieved.

Typical of a prior art electrostatic spray gun is that shown in U.S. Pat. No. 3,608,823. The spray gun disclosed in the '823 patent comprises a tube of electrically insulating material, the free end thereof supporting an atomizer for the coating material and the other end being connected to a conveying means for supplying coating material by means of a propellant gas stream. A high-voltage generator and electrodes are provided for the electric charging of the coating material and for maintaining a high-voltage field between the gun and the object to be coated. The electrodes are formed as spikes of tungsten successively projecting from the internal wall of the tube in the direction of flow of the propellant gas-coating material mixture. A disadvantage of this type of electrode structure is that the electrodes wear away relatively quickly, degrading performance of the spray gun and requiring replacement.

In U.S. Pat. No. 4,066,041, a nozzle for an electrostatic spray apparatus is provided which has at least 2 electrodes at the tip thereof. High voltage of the same polarity, but of different magnitude, is applied to the electrodes, and a transverse electrical field is generated which covers the nozzle opening. As in the '823 patent, this structure also utilizes delicate electrodes which wear away and need to be replaced at relatively frequent intervals.

U.S. Pat. No. 3,901,184 discloses an electrostatic spray nozzle containing a center conductor and having a bell-shaped deflector end. The deflector is part of the center conductor, and is therefore itself conductive. The center conductor is axially supported within the spray nozzle by an insulated spider.

U.S. Pat. No. 4,011,991 discloses a center electrode which is conductive and which charges coating particles. The center electrode includes a conductive-bell shaped deflector end.

Other patents which show a conductive center electrode in an electrostatic spray apparatus are U.S. Pat. Nos. 2,855,245; 3,774,573; and 3,056,557. None of these patents, however, relate to a muzzle for use in an electrostatic spray gun which can be quickly connected to or disconnected from the spray gun housing.

It has been found that the electrodes in the prior art structures are quite fragile, and as noted above, tend to wear away rather quickly. It would therefore be advantageous to provide a muzzle for use in an electrostatic spray gun which includes a rugged and reliable electrode, in the form of a conductive rod, which is adapted to replace the more fragile nozzle assembly in conventional electrostatic spray guns. Such a muzzle should be easy to install and remove from an electrostatic spray gun, and in order to fit in conventional spray guns, must be capable of coupling power to the center electrode without any need for modification of the spray gun itself. The muzzle must, of course, also be of a structure which efficiently and reliably imparts a proper electrostatic charge to the coating material which exits from the spray gun.

The present invention provides such a muzzle.

SUMMARY OF THE INVENTION

In accordance with the present invention, an electrostatic spray gun muzzle is provided which comprises an insulating tube having a rear end adapted to be mounted in an electrostatic spray gun and a front end providing an exit for coating material. A first electrical contact is mounted at the rear end of the tube and adapted to connect to a corresponding power terminal in an electrostatic spray gun. A conductive rod is mounted axially within the tube with a first end extending beyond the rear end of the tube and a second end extending beyond the front end of the tube. A conductive pin extends radially from the rod adjacent the first end thereof. Means is provided for electrically coupling the conductive pin to the first electrical contact. A plurality of centering bars extend radially from the rod toward the front end of the tube to maintain the rod in centered, axial alignment within the insulating tube. An insulating deflector is mounted to the second end of the conductive rod.

The centering bars which maintain the rod in centered, axial alignment within the insulating tube can be electrically conductive. It is believed that the use of electrically conductive centering bars enhances the electrostatic charging of the coating material flowing through the muzzle.

In the muzzle of the present invention, an end plug can be used, which is inserted into the rear end of the insulating tube, to contain the first electrical contact. When such an end plug is used, the means for electrically coupling the conductive pin to the first electrical contact can comprise a groove in the end plug, adapted to accomodate the conductive pin. A second electrical contact is mounted in the groove, and means are provided for connecting the second electrical contact to the first electrical contact.

The tips of the first and second ends of the conductive rod can be pointed, to provide more effective charging of the coating material. The insulating deflector can be adjustable longitudinally along the conductive rod. Further, the insulating deflector can include a cavity which encloses and extends beyond the tip of the second end of the rod to shield the tip of the second end from contacting an external object during the normal use of the muzzle.

DETAILED DESCRIPTION OF THE PREFERRED EMBODIMENT

Figure 1:
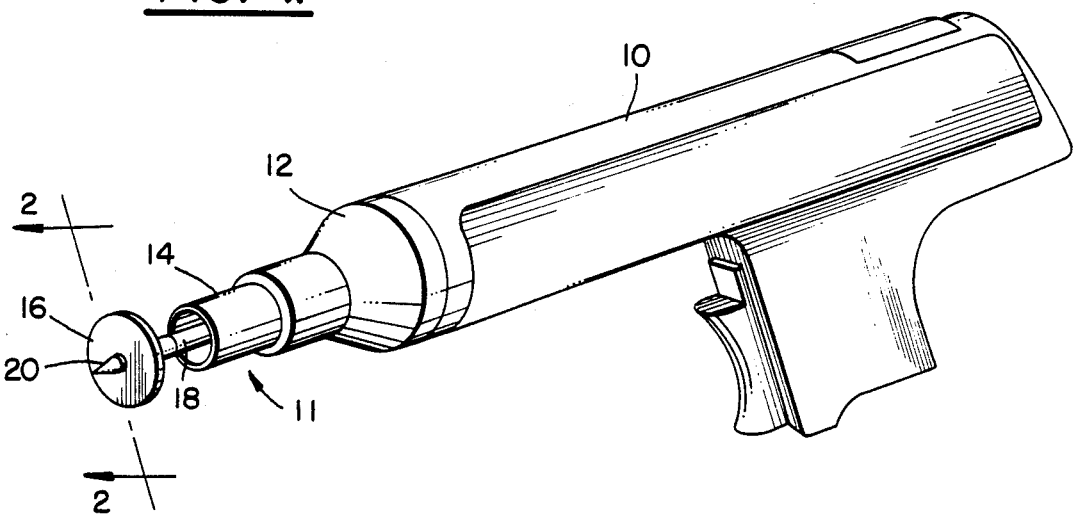
FIG. 1 is a perspective view of an electrostatic spray gun incorporating a muzzle in accordance with the present invention.
Figure 2:
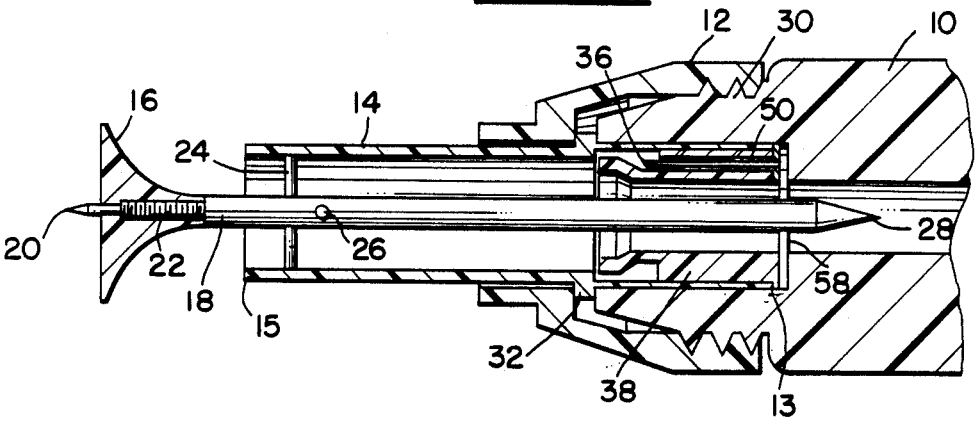
FIG. 2 is a cross sectional view taken substantially along the lines 2—2 shown in FIG. 1.

As shown in FIG. 1, a muzzle, generally designated by reference numeral 11, is inserted into the front of a conventional electrostatic spray gun 10. For purposes of the present disclosure, muzzle 11 is shown in use with an electrostatic spray gun, however, it will be appreciated by those skilled in the art that the muzzle of the present invention can also be used in electrostatic spray apparatus which is not in the form of a "gun" per se. Thus, the use of the word "gun" is not intended to limit the scope of the present invention, or the claims appended hereto.

As shown throughout the Figures, muzzle 11 comprises a insulating tube 14 having a rear end 13 and a front end 15. Rear end 13 is adapted to be mounted in electrostatic spray gun 10 and front end 15 provides an exit for coating material which flows from the electrostatic spray gun 10, through and out of insulating tube 14. Insulating tube 14 can be made of any insulating material, such as plastic, having a sufficient physical and dielectric strength. An example of an insulating material which can be used for this purpose is the acetal resin sold under the registered trademark "Delrin" by the E. I. DuPont Company. The length of insulating tube 14 can range from approximately 3 inches through 2 feet, or longer. The use of a long insulating tube in the muzzle of the present invention enables the muzzle to conveniently reach into a deep recessed area.

A conductive rod 18 is mounted axially within in insulating tube 14. Rod 18 has a first end 28 which extends beyond the rear end of insulating tube 14, and a second end 20 which extends beyond the front end of insulating tube 14. The tips of ends 20 and 28 may be pointed, as shown in the Figures. Conductive rod 18 can be fabricated from brass, copper, or other electrically conductive material.

A conductive pin 58, fabricated, for example, from stainless steel, extends radially from first end 28 of conductive rod 18. Pin 58 can be mounted by pressfitting it in a hole drilled through rod 18. A plurality of centering bars 24 and 26 extend radially from rod 18 adjacent the front end 15 of insulating tube 14. Centering bars 24 and 26 maintain rod 18 in centered, axial alignment within insulating tube 14. Centering bars 24 and 26 can be made of insulating or conductive material; however, the use of conductive centering bars will, it is believed, facilitate the charging of coating material as it flows through insulating tube 14 and across centering bars 24 and 26. The centering bars can be mounted to rod 18 in the same manner as conductive pin 58.

Figure 6:
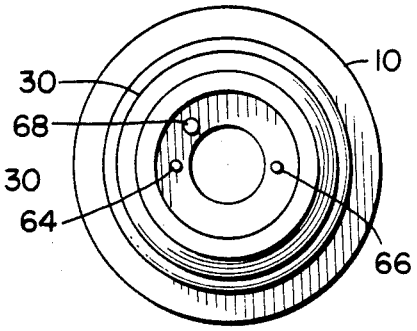
FIG. 6 is a plan view looking into the front of the spray gun shown in FIG. 1.

Means is provided for electrically connecting conductive pin 58, and hence conductive rod 18, to a power source incorporated in electrostatic spray gun 10. The muzzle shown in the Figures is particularly adapted to be used in connection with the model 700 series electrostatic spray guns manufactured and sold by Gema AG Apparatebau of St. Gallen, Switzerland, and the model 2000 series electrostatic spray guns manufactured and sold by Interrad Corporation of Fairfield, Conn. FIG. 6 shows a front end view, looking into such an electrostatic spray gun. As shown in FIG. 6, these guns include power terminals 64, 66, and 68 which are connected to a power source within the spray gun. The muzzle of the present invention, depicted in the Figures, utilizes power terminal 64 of spray gun 10 to energize conductive rod 18.

Figure 3:
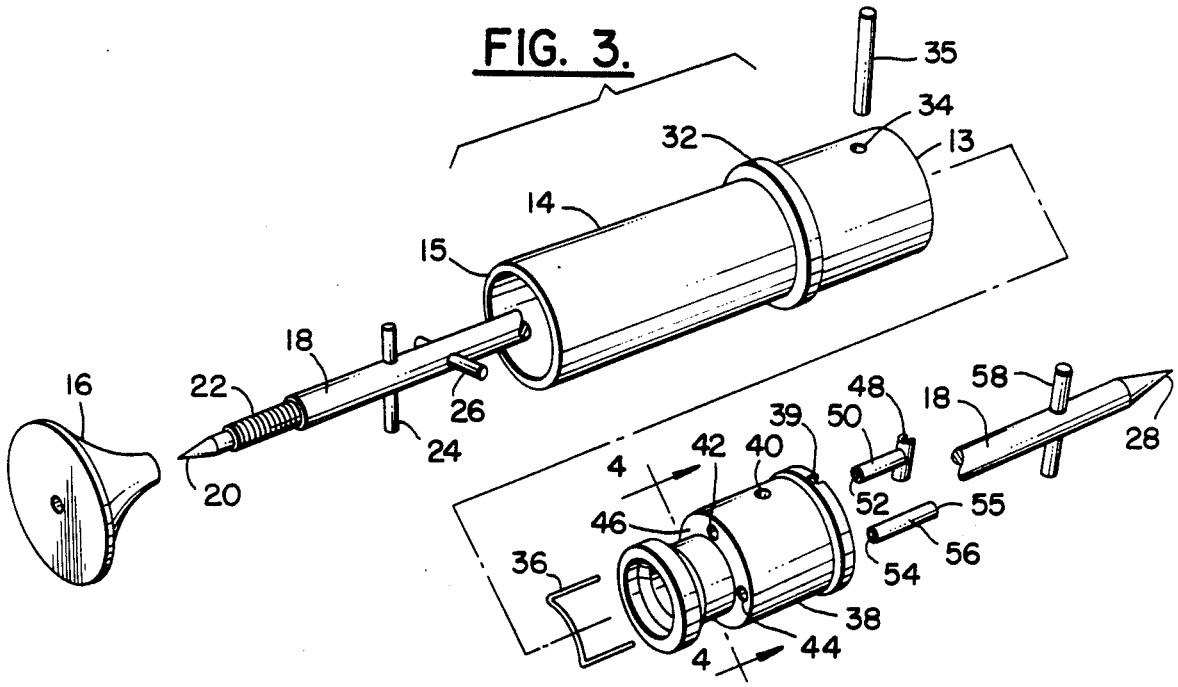
FIG. 3 is an exploded view of the muzzle of the present invention.
Figure 4:
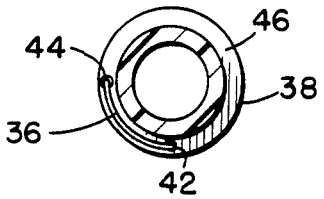
FIG. 4 is a cross-sectional view taken substantially along the lines 4—4 of FIG. 3.

One means for electrically connecting conductive pin 58, and hence conductive rod 18, to power terminal 64 of spray gun 10 is to use an end plug 38 which is mounted at the rear end 13 of insulating tube 14. A first electrical contact 56 in end plug 38 is adapted to engage corresponding power terminal 64 in electrostatic spray gun 10. Open end 55 of first electrical contact 56 slides over pin 64 when muzzle 11 is inserted into spray gun 10. Open end 54 of first electrical contact 56 is connected to a jumper wire 36, which in turn is connected to the open end 52 of a second electrical contact 50 in end plug 38. End plug 38 includes a groove 39 to accomodate conductive pin 58 which extends radially from conductive rod 18. Conductive portion 48 of second electrical contact 50 lines groove 39, so that when conductive pin 58 is inserted into groove 39, it is electrically connected to first electrical contact 56 through jumper wire 36 and second electrical contact 50. Jumper wire 36 is run along shoulder 46 and routed through channels 42 and 44 of end plug 38 as shown in FIG. 3.

Figure 5:
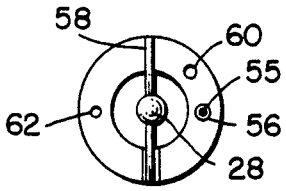
FIG. 5 is a end view of the rear of the muzzle.

End plug 38 is retained in insulating tube 14 by the use of a locking pin 35 which protrudes through holes 34 and 40 in insulated tube 14 and end plug 38 respectively. End plug 38 also includes holes 60 and 62, as shown in FIG. 5, so that the completed muzzle assembly 11 can be inserted into a conventional spray gun without modifying the spray gun by breaking off unused power terminals 66 and 68. A conical nut 12 screws onto threads 30 at the front end of spray gun 10 to clamp muzzle 11 into spray gun 10. When insulating tube 14 of muzzle 11 is inserted into spray gun 10, its travel is limited by shoulder 32 which abuts against the front of spray gun 10.

The muzzle of the present invention also comprises an insulating deflector 16 which is mounted to second end 20 of conductive rod 18, forward of front end 15 of insulating tube 14. Insulating deflector 16 is mounted to conductive rod 18 through the use of interengaging threads 22. The distance of insulating deflector 16 from front end 15 of insulating tube 14 is adjustable longitudinally along the axis of conductive rod 18, by screwing the deflector toward or away from front end 15. Insulating deflector 16 can be fabricated from any suitable insulating material, such as, for example, the plastic sold under the registered trademark "Delrin".

Figure 7:
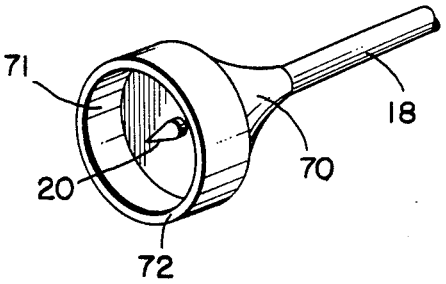
FIG. 7 is a perspective view of an alternate form of insulating deflector.

During operation of the muzzle, conductive rod 18 will be maintained at a high voltage for charging of coating material flowing through insulating tube 14. In order to prevent arcing from the second end 20 of conductive rod 18 to an external object, an insulating deflector 70 of the type shown in FIG. 7 can be used. Insulating deflector 70 includes a cavity 71 enclosing and extending beyond the tip of the second end 20 of rod 18. Cavity 71 shields the tip of the second end 20 of conductive rod 18 from contacting an external object during the normal use of the muzzle. Cavity 71 is formed by providing a collar 72 along the perimeter of insulating deflector 70.

I claim:

1. A muzzle for use in an electrostatic spray gun comprising:

an insulating tube having a rear end adapted to be mounted in an electrostatic spray gun and a front end providing an exit for coating material;

a conductive rod mounted axially within said tube;

a conductive pin extending radially from said rod at one end thereof; and means for electrically connecting said pin to a power terminal when the rear end of said insulated tube is mounted in a spray gun including:

an end plug mounted at the rear end of said insulating tube;

a first electrical contact in said end plug adapted to engage a corresponding power terminal in an electrostatic spray gun; and a second electrical contact in said end plug connected to said first electrical contact and adapted to engage said radially extending conductive pin, wherein said end plug includes a groove to accommodate said radially extending pin, and said second electrical contact comprises a conductive member lining said groove.

2. The muzzle of claim 1 further comprising a plurality of conductive centering bars extending radially from said rod to maintain the rod in centered, axial alignment within said insulating tube.

3. The muzzle of claim 2 wherein said plurality of centering bars are located adjacent the front end of said insulating tube.

4. The muzzle of claim 1 further comprising an insulating deflector mounted to the other end of said conductive rod, forward of the front end of the insulating tube.

5. The muzzle of claim 4 wherein the distance of said insulating deflector from said front end is adjustable longitudinally along the axis of said conductive rod.

6. The muzzle of claim 5 wherein said insulating deflector and said conductive rod are threadedly engaged and said insulating deflector is adjusted by screwing it toward or away from said front end.

7. The muzzle of claim 1 wherein the tip of the other end of said conductive rod is pointed.

8. An electrostatic spray gun muzzle comprising:

an insulating tube having a rear end adapted to be mounted in an electrostatic spray gun and a front end providing an exit for coating material;

a first electrical contact mounted at the rear end of said tube and adapted to connect to a corresponding power terminal in an electrostatic spray gun;

a conductive rod mounted axially within said tube with a first end extending beyond the rear end of said tube and a second end extending beyond the front end of said tube;

a conductive pin extending radially from said rod adjacent the first end thereof;

means for electrically coupling said conductive pin to said first electrical contact;

a plurality of centering bars extending radially from said rod toward the front end of said tube to maintain the rod in centered, axial alignment within said insulating tube;

an insulating deflector mounted to the second end of said rod; and an end plug inserted into the rear end of said tube, said end plug containing said first electrical contact, and said means for electrically coupling said conductive pin to said first electrical contact comprising:

a groove in said end plug adapted to accommodate said conductive pin, a second electrical contact mounted in said groove, and means for connecting said second electrical contact to said first electrical contact.

9. The muzzle of claim 8 wherein said centering bars are electrically conductive.

10. The muzzle of claim 8 wherein the position of said insulating deflector is adjustable longitudinally along said conductive rod.

11. The muzzle of claim 8 wherein the tip of the second end of said conductive rod is pointed.

12. The muzzle of claim 11 wherein the tip of the first end of said conductive rod is pointed.

13. The muzzle of claim 11 wherein the pointed tip of the second end of said rod extends beyond said insulating deflector.

14. The muzzle of claim 11 wherein the insulating deflector includes a cavity enclosing and extending beyond the tip of the second end of said rod to shield the tip of the second end from contacting an external object during normal use of the muzzle.

15. The muzzle of claim 8 wherein the insulating deflector includes a cavity enclosing and extending beyond the tip of the second end of said rod to shield the tip of the second end from contacting an external object during normal use of the muzzle.

* * * * *